United States Patent [19]

Trias

[11] Patent Number: 4,859,218

[45] Date of Patent: Aug. 22, 1989

[54] DEVICE FOR CONTROLLING REFUSE DISCHARGE IN TEXTILE CLEANERS

[76] Inventor: Jose R. Trias, Fontcuberta, 24-Urbanizacion "La Coromina", Manlleu, Spain

[21] Appl. No.: 62,469

[22] Filed: Jun. 12, 1987

[30] Foreign Application Priority Data

Jun. 20, 1986 [ES] Spain ..... 294958

[51] Int. Cl.[4] ..... B01D 29/04; B01D 46/10

[52] U.S. Cl. ..... 55/213; 55/218; 55/274; 55/356; 55/471

[58] Field of Search ..... 55/213, 218, 210, 274, 55/283, 303, 310, 311, 356, 430, 431, DIG. 34

[56] References Cited

U.S. PATENT DOCUMENTS

| | | | |
|---|---|---|---|
| 2,509,505 | 5/1950 | Johnson | 55/213 |
| 2,633,206 | 3/1953 | Bruckner | 55/213 |
| 2,700,362 | 1/1955 | Calling | 55/274 X |
| 2,715,946 | 8/1955 | Peterson | 55/213 |
| 2,741,330 | 4/1956 | Kaess | 55/213 X |
| 3,172,743 | 3/1965 | Kowalewski | 55/214 |
| 3,177,635 | 4/1965 | Cawl et al. | 55/274 |
| 3,601,955 | 8/1971 | Ferri | 55/430 X |
| 3,762,143 | 10/1973 | Stewart | 55/283 X |
| 4,134,745 | 1/1979 | Furstenberg | 55/356 X |
| 4,222,754 | 9/1980 | Horvat | 55/431 X |
| 4,233,597 | 11/1980 | Kurz | 55/274 X |
| 4,353,721 | 10/1982 | Mollstatter | 55/431 X |

FOREIGN PATENT DOCUMENTS

| | | | |
|---|---|---|---|
| 846368 | 8/1952 | Fed. Rep. of Germany | 55/431 |

*Primary Examiner*—Robert Spitzer
*Attorney, Agent, or Firm*—Michael J. Striker

[57] ABSTRACT

A control unit for controlling refuse discharge in a textile cleaner comprises a spring-biased membrane which is in contact with a pressure chamber or a vacuum chamber of the cleaner in which a turbine and a refuse collecting filter are installed. An electrical circuit is connected with a fixed contact, and another contact mounted on the membrane. When another contact is moved by the membrane in response to the pressure condition in the respective chamber so that the spring force is overcome the movable contact comes into contact with the detector, and a signal is issued to discharge refuse from the filter.

7 Claims, 2 Drawing Sheets

DEVICE FOR CONTROLLING REFUSE DISCHARGE IN TEXTILE CLEANERS

BACKGROUND OF THE INVENTION

The present invention pertains to a control unit for signalling and automatically controlling the moment of discharge of textile refuse accumulated on the filters of the travelling textile cleaners.

Due to the control system of the type under discussion, it is possible to check at any moment whether the refuse discharge must be performed.

SUMMARY OF THE INVENTION

It is an object of the present invention to provide an improved device for controlling refuse discharge in textile cleaners, particularly travelling textile cleaners.

This and other objects of the invention are attained by a control device for controlling refuse discharge in a textile cleaner having a pressure chamber and an underpressure chamber, a turbine positioned in said pressure chamber and connected with the underpressure chamber, and a filter on which refuse is accumulated which may disturb a turbine operation. The control device comprises a membrane being in contact with one of said chambers; first contact means fixed on said membrane; a housing having a bottom and closed at one side opposite to said bottom with said membrane; spring means biasing said membrane and positioned in said housing; and electrical means including a screw extending into said housing and forming second contact means. The second contact means is fixed. The first contact means is movable by said membrane responsive to pressure conditions in one of the chambers against a force of the spring means. If the force of the spring means is exceeded by a deflection of the membrane, the first contact means comes into contact with the second contact means, and the electrical means issues a signal indicating a discharge of the refuse accumulated on the filter to be performed.

The membrane may be in contact with the pressure chamber.

The screw may be mounted at the bottom and be adjustable in position by a differential washer so as to initially adjust a gap between the first and second contact means.

The membrane may be in contact with the underpressure chamber.

The first contact means may be a screw carrying a stop arm adjustable in position so as to initially adjust a gap between the first and second contact means.

The electrical means may be a conventional electrical circuit of the cleaner, connected with the screw and being closed when the screw comes in contact with the first contact means moved by the membrane to issue the signal.

The housing of the control unit may be box-shaped.

Essentially, the control device or unit is characterized by its high pressure or vacuum operation in the cleaner chamber in which there is a separator filter and with which the turbine is connected. An electrical circuit sets the unit to operation. The cleaner devices are designed to discharge at a proper point a refuse, such as fly, threads and the like, and have the filter on which a coat or layer of refuse forms which can neutralize the turbine operation. The membrane is continuously under tensioning of an internal spring which maintains a gap between two contacts of the electrical circuit while the assembly is inoperative. The first contact is a central stop positioned in the membrane and is movable by the membrane. The second contact is a fixed screw and is normally placed at the bottom of a box at the edge of which the membrane is fixed. When the pressure acting on the assembly is high enough, due to the filter clogging, connection between the above mentioned contacts takes place to close the electrical circuit. The gap between the screw and the central stop or the contact of the membrane is adjusted either by moving directly the membrane or the screw via a bushing or washer.

The novel features which are considered as characteristic for the invention are set forth in particular in the appended claims. The invention itself, however, both as to its contruction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
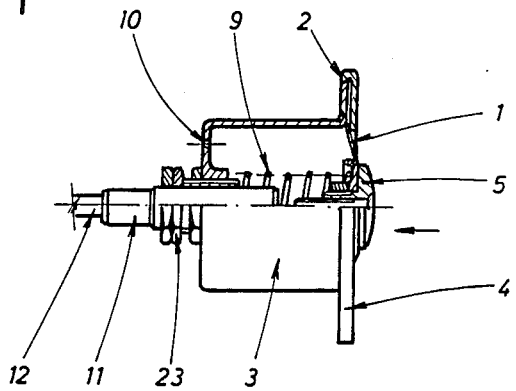
FIG. 1 is a partial cross section of the embodiment of the membrane assembly which is operated at high pressure.
Figure 2:
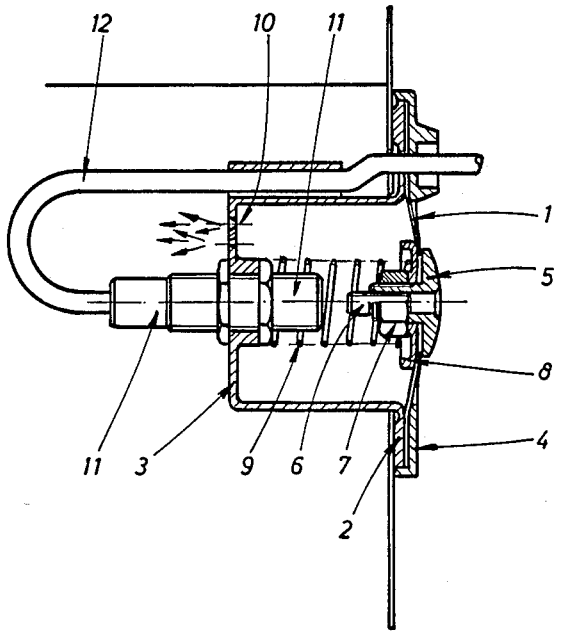
FIG. 2 shows the embodiment of the control assembly in crosssection, on enlarged scale, which assembly is operated at underpressure.
Figure 3:
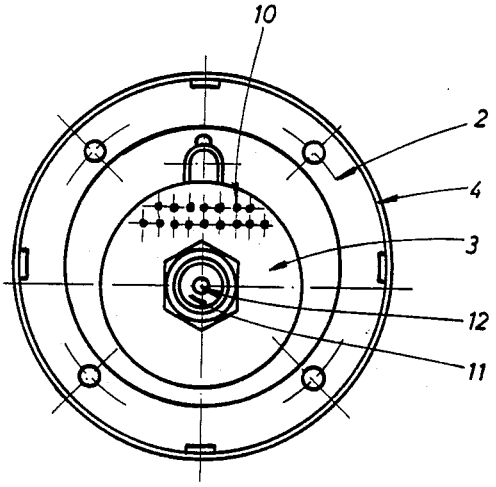
FIG. 3 is a back view of the assembly of FIG. 1.

Referring now to the drawings in detail, and firstly to FIGS. 1 and 2 thereof, it will be seen that the control unit according to the invention includes a membrane unit with a membrane 1 which has a circular shape and can be of any suitable material, a box-like housing 3 having a flange 2 to which the membrance or diaphragm 1 is applied, and a retaining ring 4 for holding the membrane 1 to the housing 3.

A screw 5 extends through the center of membrane 1. This screw has an axial opening in which a threaded stem 6 is provided. Stem 6 acts as an adjusting stop. A washer 8 is fixed by a nut 7 to the internal side of the membrane 1. Washer 8 receives the end of a helical spring 9 which is supported at its other end against the bottom of the box-like housing 3. A plurality of holes 10 are formed in the bottom wall of housing 3. Air flows through opening 10 in the direction of arrows in FIG. 2. A central opening in the bottom wall of housing 3 receives a screw 11 which is connected to electrical conductors 12 which form a part of the electrical circuit of the refuse discharge control.

The membrane unit of FIG. 1 is designed to operate at pressure whereas the membrane unit of the embodiment of FIG. 2 is designated to operate at underpressure.

Figure 4:
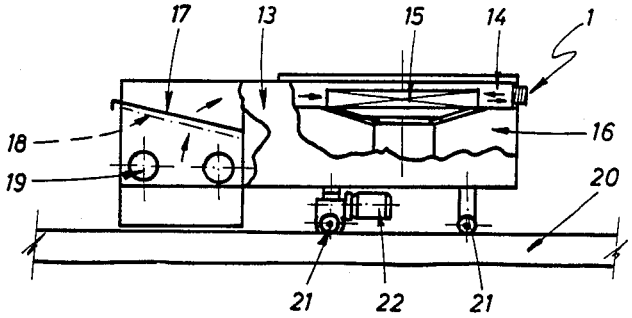
FIGS. 4 and 5 show two possible embodiments of assembling the membrane unit in a cart of the travelling textile cleaner.

With reference to FIG. 4 it is seen that the membrane unit of FIG. 1 is mounted on the cart or a traveller 13 of a textile cleaner. The membrane unit is in communication with a cleaner's chamber 14. Turbine blades 15 are positioned in the pressure area of chamber 14.

Figure 5:
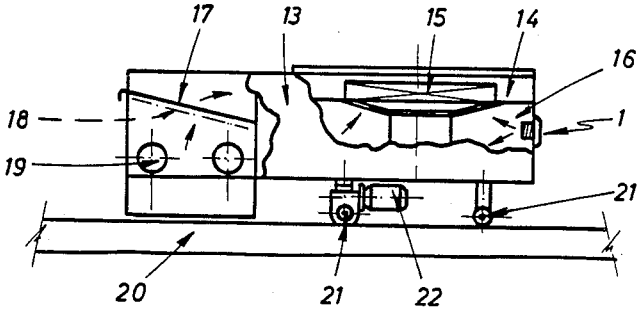

The membrane unit of the embodiment of FIG. 2 is mounted on the cart 13 as shown in FIG. 5. Namely, in this embodiment, the membrane unit is in connection with a lower chamber 16 which is an underpressure or vacuum area.

The cart 13 in both embodiments of FIGS. 4 and 5 has inserted a commercially available filter 17. Fly 18 is accumulated under filter 17. This fly is driven through openings 19 to which suction hoses are connected. The movements of the cart 13 are executed by means of rails 20, on which rollers 21, driven by a motor 22, roll.

In the embodiment of FIG. 1 the membrane unit also has a differential washer 23.

The mode of operation of the control unit of the invention is as follows:

In the embodiment of FIGS. 1 and 4, in which the membrane is in communication with the pressure chamber 14, the turbine 15 sucks air away through filter 17 to develop high pressure in chamber 14. This high pressure acts on the membrane 1, the deflection of which displaces the screw 5 and thereby stop 6 so that the latter would contact the screw 11 which is connected to the electrical circuit via leads 12. When filter 17 is saturated with refuse the minimal suction limit would be reached and the pressure in chamber 14 would drop so as to free the membrane which would resume its initial position, whereby the permanent signal at the electrical circuit would be cancelled. The cleaner devices would automatically discharge refuse due to the operation of the electrical circuit.

It is possible to adjust the refuse load 18 accumulated at the filter 17 by means of stop 6 which is movable to and from the screw 11. If the internal end of the stop 6 approaches screw 11 the refuse load 18 is reduced and it can be increased when stop 6 of the screw 5 is remote from the screw 11. Thereby, by a voluntary operation the refuse load accumulated at the moment of discharge can be adjusted.

The operational characteristics of the membrane 1 in both embodiments of FIGS. 1 and 2 are substantially the same with the single difference in that screw 11 in the embodiment of FIG. 1 can be moved to and from the stop 6 for the aforedescribed adjustment purposes by means of the differential washer 23.

In the embodiment of FIGS. 2 and 5 in which the membrane is in communication with the suction chamber 16 the turbine blades 15 suck air away through the filter 17. When filter 17 is saturated with refuse, such as fly, threads and the like, a layer is formed on the filter, which layer obstructs the air flow which reaches therefore a minimal circulation. At this moment, turbine 15 produces vacuum which acts on the membrane 1 with the force which exceeds the force of resistance of spring 9. The deflection of the membrane causes the stem or stop 6 to contact the screw 11 whereby a signal is generated which through electrical conductors 12 is delivered to the electrical circuit (not shown) which normally sets to operation the structural components of the textile cleaner so as cause the discharge of refuse 18 to a place designated for such a purpose.

It is possible to check with the above-described membrane system whether the refuse discharge takes place correctly. If such a discharge is executed the control unit continues to issue discharge signals until the discharge is correctly realized. Should the discharge signal persist an operator should remove filter 17 and clean the same.

It will be understood that each of the elements described above, or two or more together, may also find a useful application in other types of control devices for refuse discharge in textile cleaners differing from the types described above.

While the invention has been illustrated and described as embodied in a control device for refuse discharge in textile cleaners, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A textile cleaner in combination with a control device for controlling refuse discharge in the textile cleaner, the textile cleaner comprising a pressure chamber and an underpressure chamber, a turbine in said pressure chamber, and a filter located upstream of said turbine so that said turbine suctions air through said filter into said chambers and thereby refuse accumulated on said filter disturbs operation of said turbine, the control device comprising:

a housing with an open face and at least one hole;

a deflectable membrane closing said open face, said membrane being in contact with one of said chambers;

spring means for biasing said membrane, said spring means being in said housing and being formed to exert a biasing force, said membrane being formed to deflect in response to pressure forces acting against said membrane in opposition to said biasing force when said pressure forces are greater than said biasing force;

electrical contact means including a first contact member fixed on said membrane and a second contact member extending into said housing, said first contact member being movable by said membrane into contact with said second contact member against said biasing force in response to said membrane deflecting; and means for adjusting a position of one of said contact members relative to the other of said contact members to initially adjust a gap between said contact members so as to limit an accumulation of the refuse on the filter prior to said contact becoming effected between said contact members.

2. The combination as defined in claim 1, wherein said membrane is in contact with said pressure chamber.

3. The combination as defined in claim 2, wherein said housing has a bottom opposite said membrane, said second contact member being formed as a screw mounted at said bottom, said adjusting means including a differential washer formed to adjust a position of said screw so as to initially adjust said gap between said first and second contact members.

4. The combination as defined in claim 1, wherein said membrane is in contact with said underpressure chamber.

5. The combination as defined in claim 4, wherein said first contact member is a screw carrying a stop, said stop being arranged so that said contact is effected by said second contact member contacting said stop, said screw and said stop having interengaging surfaces constituting said adjusting means, said stop being adjustable in position on said screw so as to initially adjust said gap between said first and said second contact members.

6. A control device for controlling refuse discharge in the textile cleaner, the control device comprising:

a housing with an open face and at least one hole;

a deflectable membrane closing said open face;

spring means for biasing said membrane, said spring means being in said housing and being formed to exert a biasing force, said membrane being formed to deflect in response to pressure forces acting against said membrane in opposition to said biasing force when said pressure forces are greater than said biasing force;

electrical contact means including a first contact member fixed on said membrane and a second contact member extending into said housing, said first contact member being movable by said membrane into contact with said second contact member against said biasing force in response to said membrane deflecting under the action of overpressure, and movable out of contact with said second contact member in response to said membrane deflecting under the action of underpressure; and means for adjusting a position of one of said contact members relative to the other of said contact members to initially adjust a gap between said contact members.

7. The device as defined in claim 6, wherein said housing is box-shaped.

* * * * *